US006545239B2

(12) United States Patent
Spedale et al.

(10) Patent No.: US 6,545,239 B2
(45) Date of Patent: Apr. 8, 2003

(54) ROCKER SWITCH WITH SNAP DOME CONTACTS

(75) Inventors: Joseph J. Spedale, Chicago, IL (US); Michael S. Pedersen, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/925,387

(22) Filed: Aug. 9, 2001

(65) Prior Publication Data

US 2003/0029710 A1 Feb. 13, 2003

(51) Int. Cl.[7] ..... H01H 21/00
(52) U.S. Cl. ..... 200/553; 200/5 R
(58) Field of Search ..... 200/517, 550, 200/315, 5 R, 339

(56) References Cited

U.S. PATENT DOCUMENTS

| | | | | |
|---|---|---|---|---|
| 4,436,970 A | | 3/1984 | Swisher | 200/61.56 |
| 4,739,127 A | * | 4/1988 | Higuchi et al. | 200/241 |
| 4,892,988 A | | 1/1990 | Ishii | |
| 4,933,522 A | | 6/1990 | Celander | |
| 5,584,380 A | * | 12/1996 | Naitou | 200/315 |
| 5,598,918 A | | 2/1997 | Malecke et al. | |
| 5,833,048 A | * | 11/1998 | Dilly | 200/315 |
| 5,865,303 A | | 2/1999 | Gernhardt et al. | |
| 5,898,147 A | | 4/1999 | Domzalski et al. | |
| 5,924,555 A | | 7/1999 | Sadamori et al. | |
| 5,933,069 A | * | 8/1999 | Huang | 200/310 |
| 5,950,812 A | | 9/1999 | Tanacan et al. | |
| 5,982,269 A | | 11/1999 | Sorenson | |
| 5,986,228 A | | 11/1999 | Okamoto et al. | |
| 5,999,084 A | | 12/1999 | Armstrong | |
| 6,066,815 A | | 5/2000 | Spedale | |

FOREIGN PATENT DOCUMENTS

| | | | |
|---|---|---|---|
| DE | 4242100 | * | 6/1994 |
| EP | 0 516 544 A1 | | 5/1992 |
| JP | 5041141 | * | 2/1993 |

* cited by examiner

*Primary Examiner*—Elvin Enad
*Assistant Examiner*—Lisa Klaus
(74) *Attorney, Agent, or Firm*—Mark W. Croll; Paul F. Donovan

(57) ABSTRACT

A rocker switch assembly comprises a rocker switch housing having a ground contact and first and second electrical circuit contact pins mounted therein. Snap-dome contacts are operatively associated with, but normally electrically disengaged from, each one of the first and second electrical circuit contact pins, and are normally disposed in electrical contact with the ground plate. A rocker actuator has first and second actuator posts integral therewith and depending therefrom so as to normally be disposed in contact with the snap-dome contacts. Depression of one side of the rocker actuator therefore forces one of the actuator posts to in turn force its associated snap-dome contact into engagement with its respective electrical circuit contact pin so as to CLOSE the electrical circuit controlled by such electrical circuit contact pin. The engagement of the actuator posts with the snap-dome contacts rocker switch facilitates a small-throw movement of the rocker actuator and tactile feedback to the operator confirming contact of the snap-dome contact with the electrical circuit contact pin and closure of the electrical circuit controlled thereby.

17 Claims, 4 Drawing Sheets

ROCKER SWITCH WITH SNAP DOME CONTACTS

FIELD OF THE INVENTION

The present invention relates generally to rocker switches, and more particularly to a new and improved rocker switch which has snap dome contacts incorporated therein so as to provide the rocker switch with a shortened actuation stroke and a tactile feel which is desirable in connection with switch applications which require rapidly or accurately controlled incremental movements in both a positive and negative sense, or in other words, applications which comprise incremental movements in opposite directions.

BACKGROUND OF THE INVENTION

Rocker switch assemblies or mechanisms are of course well-known in the electrical switch industry. Examples of rocker switches may be found within U.S. Pat. No. 6,066,815 which issued on May 23, 2000 to Joseph J. Spedale, U.S. Pat. No. 5,982,269 which issued on Nov. 9, 1999 to Richard W. Sorenson, U.S Pat. No. 5,950,812 which issued on Sep. 14, 1999 to Tanacan et al., U.S. Pat. No. 5,865,303 which issued on Feb. 2, 1999 to Gernhardt et al., U.S. Pat. No. 5,598,918 which issued on Feb. 4, 1997 to Malecke et al., and U.S. Pat. No. 5,584,380 which issued to Kiyotaka Naitou on Dec. 17, 1996. Snap-dome contact assemblies are likewise well-known in the industry and have been employed within a wide variety of applications. Exemplary snap-dome type contact assemblies are disclosed within U.S. Pat. No. 5,999,084 which issued to Brad A. Armstrong on Dec. 7, 1999, U.S. Pat. No. 5,986,228 which issued on Nov. 16, 1999 to Okamoto et al., U.S. Pat. No. 5,924,555 which issued on Jul. 20, 1999 to Sadamori et al., U.S. Pat. No. 5,898,147 which issued on Apr. 27, 1999 to Domzalski et al., U.S. Pat. No. 4,933,522 which issued on Jun. 12, 1990 to Ronald C. Celander, and U.S. Pat. No. 4,892,988 which issued on Jan. 9, 1990 to Toshihiro Ishii.

As can readily be seen and appreciated from the aforenoted patents directed toward the snap-dome contact assemblies, snap-dome contacts are usually used within panel or membrane type applications. Similarly, as can readily be seen and appreciated from the aforenoted patents directed toward the rocker switch assemblies and systems, while such conventional rocker switches are obviously quite satisfactory with respect to their operation or performance in connection with certain predeterminedly designed modes of operation or applications, the required throw or movement of such rocker switches, when activated for performing, for example, a circuit closure connection, is larger than required or desired for other operative modes or applications, such as for example, small throw and rapidly controllable operational movements for providing operatively associated servo drive mechanisms with rapidly and accurately controllable oppositely oriented incremental movements. In addition, when such rocker switches are to be utilized in connection with the aforenoted small throw, rapidly performed incremental movements, it is also often desired for the operator to experience or receive tactile feedback in order for the operator to properly, suitably, or accurately control the desired implementation of the aforenoted incremental movements as well as to sense the closure of the contact members in order to effectively confirm completion of the contact and the ensuing servo movement.

Unfortunately, the structure comprising conventiontional PRIOR ART rocker switches does not enable such switch assemblies to effectively provide the requisite amount of tactile feedback to the operator. For example, while a lever or rocker-type switch mechanism or assembly as disclosed within the aforenoted patent to Malecke et al. comprises a pivotal lever member 104, and a pair of dome switches 122, 124, as specifically disclosed within FIG. 8A, the substantially lateral or horizontal movement of the lever member 104, as well as the interdisposition of plunger components 126,128 between the lower end portions of the lever member 104 and the dome switches 122,124, fails to provide or facilitate the necessary tactile feedback back to the operator. Still yet further, in order to achieve movement of the conventional rocker switches back to their original non-depressed states, separate return spring mechanisms or components are often required, and accordingly, the provision of such additional mechanisms or components renders the rocker switch assemblies more expensive to manufacture.

A need therefore exists in the art for a new and improved rocker switch assembly wherein small throw and rapidly controllable oppositely oriented movements are able to be achieved while providing control operators with requisite tactile feedback, and wherein, in addition, the number of different components comprising the switch mechanism or assembly is minimized so as to render the same relatively inexpensive to manufacture.

OBJECTS OF THE INVENTION

Accordingly, it is an object of the present invention to provide a new and improved rocker switch assembly.

Another object of the present invention is to provide a new and improved rocker switch assembly which effectively overcomes the various operational drawbacks characteristic of conventional PRIOR ART rocker switch assemblies.

An additional object of the present invention is to provide a new and improved rocker switch assembly which can provide small throw, rapidly controllable operational movements for providing operatively associated servo drive mechanisms with rapidly and accurately controllable oppositely oriented incremental movements.

A further object of the present invention is to provide a new and improved rocker switch assembly which can effectively provide the operator with a requisite amount of tactile feedback in order to facilitate the rapid and accurate control by the operator of the rocker switch mechanism in order to achieve small throw, rapidly controllable operational movements for providing operatively associated servo drive mechanisms with rapidly and accurately controllable oppositely oriented incremental movements.

A last object of the present invention is to provide a new and improved rocker switch assembly which comprises a minimal number of operative components so as to render the assembly relatively inexpensive to manufacture.

SUMMARY OF THE INVENTION

The foregoing and other objectives are achieved in accordance with the teachings and principles of the present invention through the provision of a new and improved rocker switch mechanism or assembly which comprises a rocker switch housing within which there is disposed a pair of vertically oriented circuit-control contact pins, as well as a common ground plate having a vertically dependent ground contact pin integrally connected thereto. A pair of snap-dome contacts are respectively operatively associated with each one of the pair of vertically oriented circuit-control contact pins such that when each snap-dome contact is disposed in its normal, non-depressed state, the central, uppermost portion of each snap-dome contact is disposed above its respective circuit-control contact pin so as to be out of contact with, or be disengaged from, such circuit-control contact pin whereby the particular electrical circuit is disposed in an OPEN state. A rocker member is pivotally mounted upon the rocker switch housing and is integrally provided with a pair of vertically dependent snap-dome actuators or posts such that lower end extremity portions of the actuators or posts are respectively normally disposed substantially in contact with the central, uppermost portion of each snap-dome contact.

Accordingly, when a first one of the two opposite end portions of the rocker member is depressed downwardly so as to pivot the rocker member upon the rocker switch housing in, for example, a first clockwise direction, its operatively associated post-type actuator immediately causes depression of the central portion of its respective snap-dome contact so as to move the central portion of the respective snap-dome contact into contact engagement with its operatively associated circuit-control contact pin whereby a first one of two electrical circuits is now disposed in a CLOSED state. Upon removal of the depression force from the rocker member, the depressed snap-dome contact inherently returns to its normal non-depressed state thereby again opening the previously CLOSED first electrical circuit and the rocker member moves back to its normal central OFF position. In a similar manner, when a second one of the two opposite end portions of the rocker member is depressed downwardly so as to pivot the rocker member upon the rocker switch housing in, for example, a second opposite counterclockwise direction, its operatively associated post-type actuator immediately causes depression of the central portion of its respective snap-dome contact so as to move the central portion of the respective snap-dome contact into contact engagement with its operatively associated circuit-control contact pin whereby a second one of the two electrical circuits is now disposed in a CLOSED state. Upon removal of the depression force from the rocker member, the depressed snap-dome contact inherently returns to its normal non-depressed state thereby again opening the previously CLOSED second electrical circuit and the rocker member moves back to its normal central OFF position.

It can thus be appreciated that as a result of the lower extremity portions of the rocker member actuators or posts being normally disposed substantially in contact with the central portions of the snap-dome contacts when the snap-dome contacts are disposed in their normal, non-depressed, non-actuated states, the throw or movement of the rocker member, in order to achieve circuit closure, is substantially shortened. In addition, since the actuator posts comprise integral, one-piece component parts of the rocker member, and again, since the actuator posts have their lower extremity portions normally disposed substantially in contact with the central portions of the snap-dome contacts, the operator is provided with the requisite amount of tactile feedback. Accordingly, rapid and accurate control by the operator of the rocker switch mechanism in order to, in turn, achieve rapidly controllable operational movements for providing operatively associated servo drive mechanisms with rapidly and accurately controllable oppositely oriented incremental movements.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
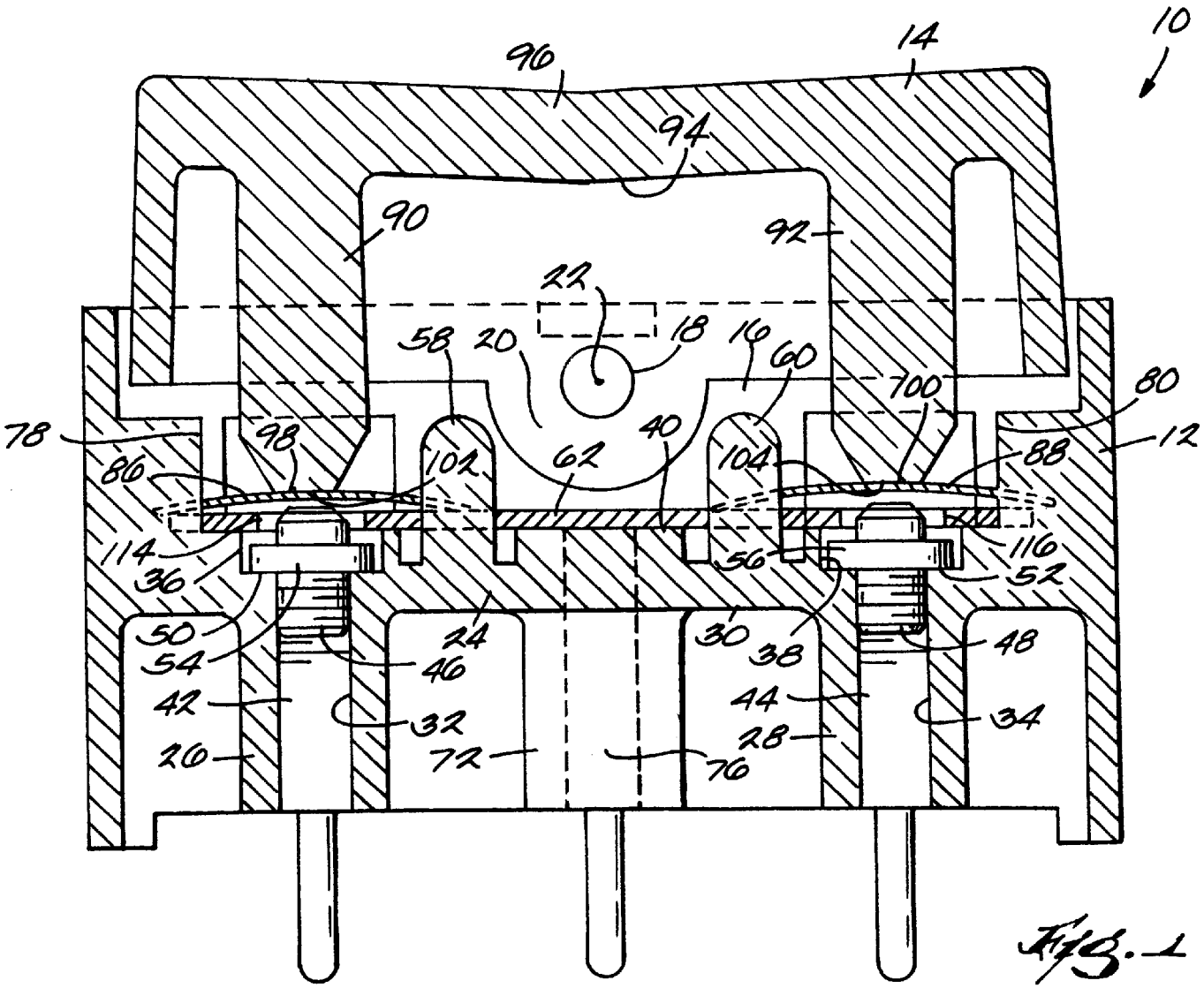
FIG. 1 is a vertical cross-sectional view of a new and improved rocker switch assembly constructed in accordance with the principles and teachings of the present invention and showing the cooperative parts thereof when the rocker switch assembly is disposed in a normally-centered OFF state.

Referring now to the drawings, and more particularly to FIG. 1 thereof, a new and improved rocker switch assembly, constructed in accordance with the principles and teachings of the present invention and showing the cooperative parts thereof, is disclosed and is generally indicated by the reference character 10. The rocker switch assembly 10 is seen to comprise a rocker switch housing 12 and a rocker switch actuator 14 wherein the rocker switch actuator 14 is pivotally mounted upon upper end portions of oppositely disposed side walls 16 of the rocker switch housing 12. More particularly, each one of the upper end portions of the oppositely disposed side walls 16 of the rocker switch housing 12 is provided with a through-aperture 18, and the oppositely disposed side walls 20 of the rocker switch actuator 14 are respectively provided with coaxially disposed oppositely extending trunnions 22 wherein the trunnions 22 are adapted to be snap-fitted within the through-apertures 18 of rocker switch housing side walls 16. It is noted that both the rocker switch housing 12 and the rocker switch actuator 14 may be fabricated from a suitable thermoplastic material.

With reference continuing to be made to FIG. 1, it is seen that the rocker switch housing 12 further comprises a horizontally extending floor or foundation portion 24 which is located at a substantially central elevational level as considered along the vertical extent or height dimension of the rocker switch housing 12, and it is seen that a pair of dependent tubular posts 26,28 project downwardly from an undersurface portion 30 of the floor or foundation 24 so as to respectively define a pair of through-bores 32, 34 therethrough. Upper end portions of the through-bores 32, 34 are countersunk, as at 36,38, within an upper surface portion 40 of the floor or foundation 24, and a pair of first and second electrical circuit contact pins 42,44 are respectively disposed within the through-bores 32, 34 of the dependent tubular posts 26,28. More particularly, it is to be appreciated that each one of the through-bores 32,34 defined within the dependent tubular posts 26,28 has a predetermined diametrical extent, and that the primary shank portion of each electrical circuit contact pin 42,44 has a diametrical extent which is just slightly less than that of its respective through-bore 32,34. The primary shank portion of each electrical circuit contact pin 42,44 is provided, however, with a radially outwardly projecting annular rib memer 46,48 whereby the first and second electrical circuit contact pins 42,44 are disposed and fixedly mounted within the respective bores 32,34 of the dependent tubular posts 26,28 through means of a press-fit or an interference fit. In addition, it is further appreciated that the countersunk portions 36,38 of the through-bores 32,34 define shoulder portions 50,52 upon which flanged head portions 54,56 of the first and second electrical circuit contact pins 42,44 are adapted to be seated when the first and second electrical circuit contact pins 42,44 are fully and properly mounted within the rocker switch housing 12.

Figure 3:
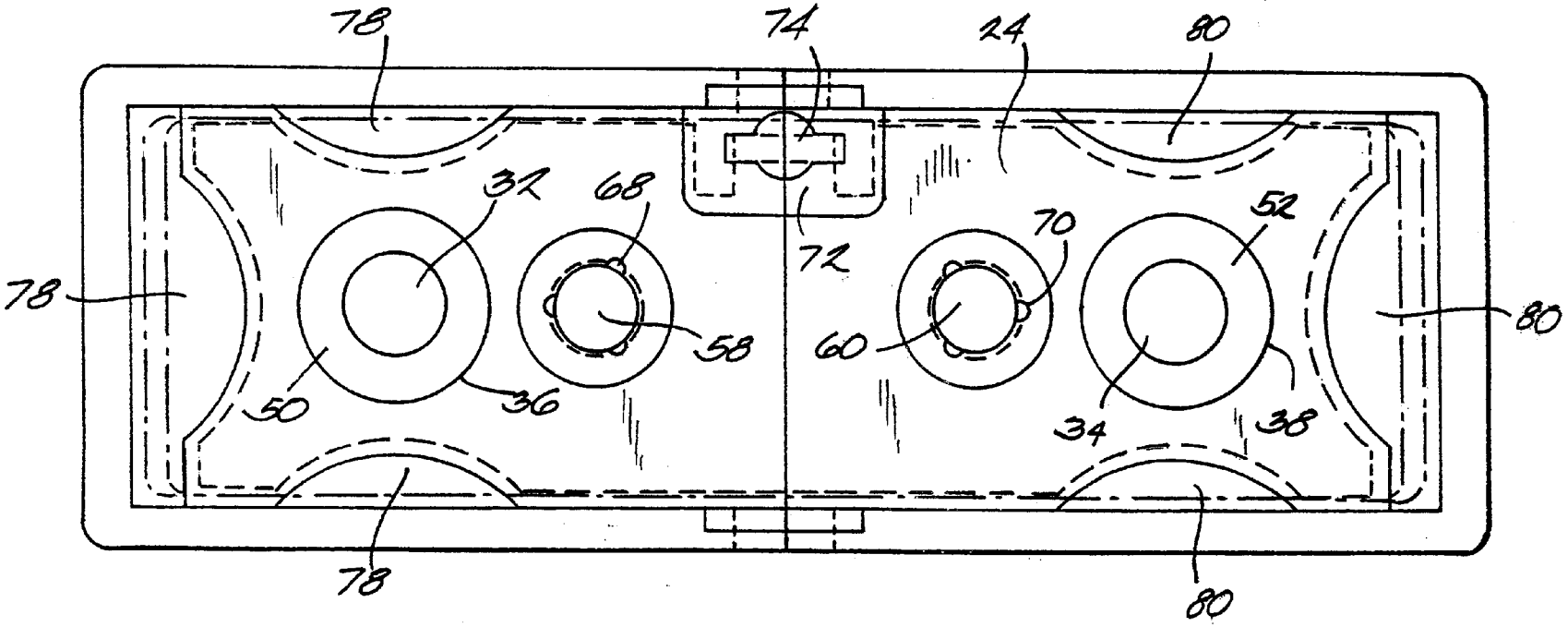
FIG. 3 is a top plan view of the rocker switch housing member of the rocker switch assembly as disclosed within FIGS. 1 and 2.
Figure 4:
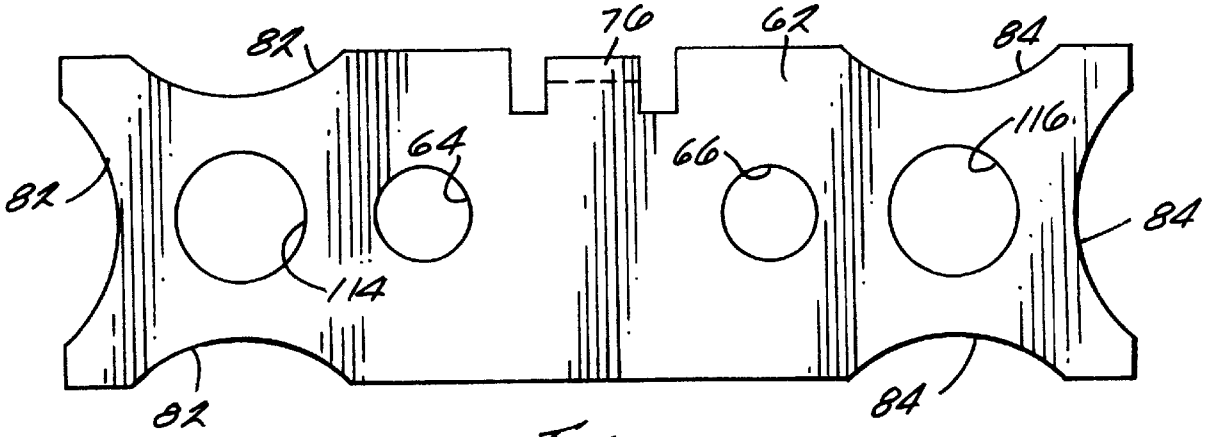
FIG. 4 is a top plan view of the ground plate component of the rocker switch assembly as disclosed within FIGS. 1 and 2.
Figure 5:
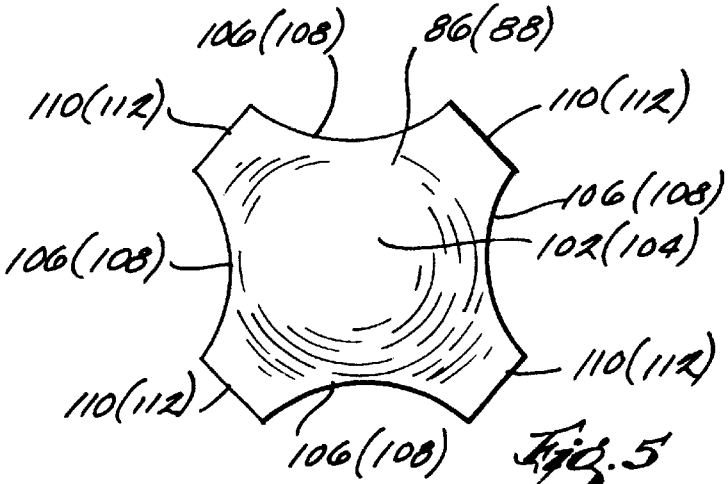
FIG. 5 is a top plan view of a snap-dome contact used within the rocker switch assembly as disclosed within FIGS. 1 and 2.

With reference still being made to FIG. 1, and with additional reference also being made to FIGS. 3 and 4, it is further seen that the rocker switch housing floor or foundation 24 is provided with a pair of transversely spaced upstanding posts 58,60, and a common or ground plate 62 is adapted to be fixedly mounted and supported upon the upper surface portion 40 of the floor or foundation 24 as a result of being disposed and fitted upon the upstanding posts 58,60. More particularly, as can best be seen from FIGS. 3 and 4, the ground plate 62 is provided with a first set of apertures 64,66 which are transversely spaced from each other by means of a center-to-center distance which substantially corresponds to the transverse spacing of the upstanding posts 58,60 of the rocker switch housing 12, and it is noted that the diametrical extent of each aperture 64,66 is substantially the same as the diametrical extent of each upstanding post 58,60. Each one of the upstanding posts 58,60 is provided with a circumferentially spaced array of crush ribs 68,70, and in this manner, when the ground plate 62 is to be mounted upon the floor or foundation 24 of the rocker switch housing 12, the apertures 64,66 of the ground plate 62 are coaxially aligned with the upstanding posts 58, 60, the ground plate 62 is then moved downwardly so as to effectively insert the upstanding posts 58,60 through the ground plate apertures 64,66, and accordingly, the interaction of the peripheral portions of the ground plate apertures 64,66 with the crush ribs 68,70 defines an interference or press fit between each apertured portion of the ground plate 62 and its upstanding mounting post 58,60.

With reference still being made to FIGS. 1, 3 and 4, it is further seen that the floor or foundation portion 24 of the rocker switch housing 12 is provided with a third downwardly extending dependent post member 72 which is located at a transversely central location along the rear wall of the switch housing 12 and which has a substantially rectangular cross-sectional configuration as can best be appreciated from FIG. 3. The interior portion of the post member 72 is provided with a substantially key-shaped slot 74, and the ground plate 62 is provided with an integrally formed, downwardly extending dependent ground pin 76 which is therefore adapted to be disposed within the key-shaped slot 74 of the post member 72 when the ground plate 62 is fixedly mounted upon the rocker switch housing 12 through means of the aforenoted interference or press fit defined between the upstanding mounting posts 58,60 and the apertured portions 64,66 of the ground plate 62. In order to properly mount and confine the disposition of the ground plate 62 upon the upper surface portion 40 of the floor or foundation portion 24 of the rocker switch housing 12, in addition to the fitted disposition of the apertured portions 64,66 of the ground plate 62 upon or with respect to the upstanding mounting posts 58,60, it is seen that the upper surface portion 40 of the floor or foundation portion 24 of rocker switch housing 12 is further provided with a plurality of upstanding scallop-shaped members 78,80 upon opposite end, and front wall and rear wall, regions thereof. In a corresponding manner, oppositely disposed, transversely spaced end portions of the ground plate 62 have scallop-shaped or arcuate regions 82,84 punched or cut out from opposite end, and front wall and rear wall, regions thereof. Accordingly, when the ground plate 62 is mounted upon the floor or foundation portion 24 of the rocker switch housing 12 as a result of being fixedly mounted upon the upstanding mounting posts 58,60 through means of the aforenoted interference or press fittings as defined between the apertured portions 64,66 of the ground plate 62 and the upstanding mounting posts 58,60, the scalloped or arcuate-shaped portions 82,84 of the ground plate 62 will likewise be operatively disposed and properly seated or mated with the scallop-shaped members 78,80 of the rocker switch housing 12.

With reference now being made to FIGS. 1 and 3–5, a pair of snap-dome contacts 86,88 are adapted to be mounted within the rocker switch housing 12 so as to be operatively associated with the first and second electrical circuit contact pins 42,44. As can best be appreciated from FIG. 1, the rocker switch actuator 14 is provided with a pair of transversely spaced dependent actuator posts 90,92 which extend vertically downwardly from an undersurface interior surface portion 94 of an operator-actuated plate portion 96. Accordingly, it is seen that when the rocker switch assembly 10 is disposed in its normal OFF state, lower end extremity portions 98,100 of the actuator posts 90,92 will be disposed substantially in contact with the elevated central portions 102,104 of the snap-dome contacts 86,88, however, such elevated central portions 102,104 of the snap-dome contacts 86,88 are, at such time, not disposed in contact with, or are disengaged from, the upper end portions of the first and second electrical circuit contact pins 42,44. It is additionally seen from FIG. 5 that each one of the snap-dome contacts 86,88 has a substantially X-shaped or +-shaped configuration wherein each side of the contact 86 or 88 has a scalloped or arcuately-shaped cut-out or punched-out region 106,108, and a leg member 110,112 defined within corner regions of each snap-dome contact 86,88. Accordingly, it can be further appreciated that when the snap-dome contacts 86,88 are to be mounted within the rocker switch housing 12, the leg members 110,112 will support the snap-dome contacts 86,88 upon the upper surface portion of the ground plate 62, and forward and backward, as well as transverse movements of the snap-dome contacts 86,88 will effectively be prevented as a result of the cooperative engagement of the scalloped side portions 106,108 of the snap-dome contacts with the upstanding scallop-shaped members 78,80 of the rocker switch housing 12 as well as the upstanding mounting posts 58,60.

In order to ensure the fact that the ground plate 62 is electrically isolated from the first and second electrical circuit contact pins 42,44, other than when a particular one of two electrical circuits is to be defined or CLOSED between the ground pin 76-ground plate 62 and one of the first and second electrical circuit contact pins 42,44 through the intermediary of a respective one of the snap-dome contacts 86,88, it is noted that the ground plate 62 is further provided with a pair of apertures 114,116 through which the upper end portions of the first and second electrical circuit contact pins 42,44 can freely project as best seen in FIG. 1. Consequently, electrical connection is only established between the ground plate 62 and one of the first and second electrical circuit contact pins 42,44 when the elevated central portion 102,104 of the particular or respective snap-dome contact 86,88 is depressed downwardly into contact with the upper end portion of the first or second electrical circuit contact pin 42,44 by means of a particular or respective one of the rocker actuator posts 90, 92.

Figure 2:
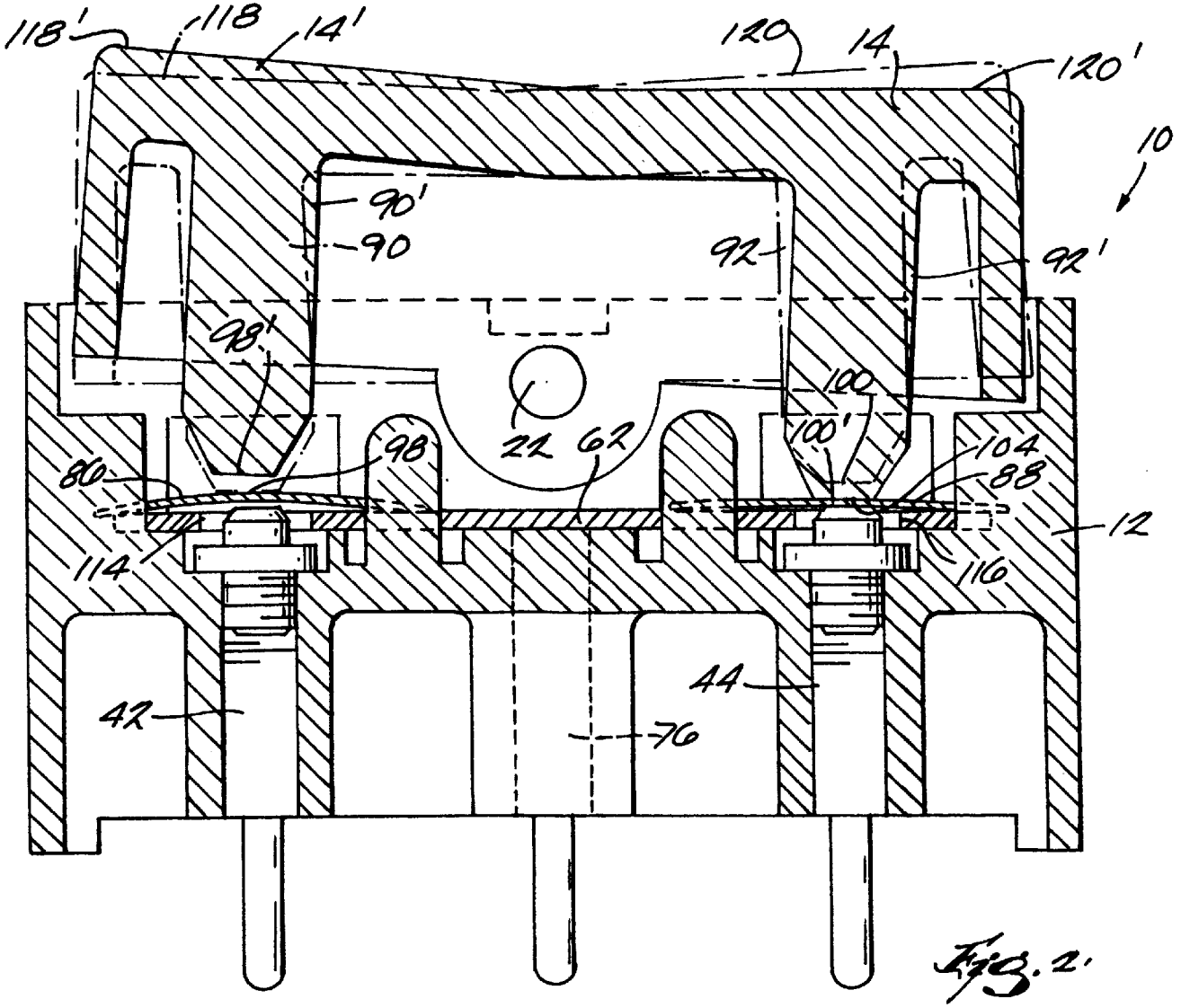
FIG. 2 is a vertical cross-sectional view of the new and improved rocker switch assembly disclosed within FIG. 1 showing the cooperative parts thereof both when the rocker switch assembly is disposed in a normally-centered OFF state and when the new and improved rocker switch assembly is disposed in a first actuated state whereby a first one of the two electrical circuits controlled by means of the rocker switch assembly is disposed in a CLOSED state.

With reference now being made to FIG. 2, the operation of the new and improved rocker switch assembly 10, constructed in accordance with the principles and teachings of the present invention, will now be described. As has been noted hereinbefore, when the rocker switch assembly 10 is disposed in a non-actuated state, the rocker switch actuator 14 is normally disposed in its non-tilted, non-actuated and centered position or state, as also shown in FIG. 1, as a result of both of the snap-dome contacts 86,88 biasing the rocker switch actuator 14 with equalized forces as transmitted to the rocker switch actuator 14 from the snap-dome contacts 86,88 through means of the actuator posts 90,92. As a result of such disposition of the rocker switch assembly 10, both of the snap-dome contacts 86,88 are disposed out of contact with respect to their respective first and second electrical circuit contact pins 42,44 whereby the first and second electrical circuits are disposed in an OPEN state. It is noted that the upper surface portion of the rocker switch actuator 14 comprises two oppositely inclined substantially planar fingertip engagement portions 118,120 for facilitating actuation of the rocker switch actuator 14. Accordingly, when, for example, the rocker switch actuator 14 is rocked pivoted, or tilted in the clockwise direction about its trunnions 22 as.a result of a downward depression force being impressed upon the right fingertip engagement portion 120 of the actuator 14 so as to be disposed at the position 14', the right actuator post 92 will be accordingly tilted to the position shown at 92', but most importantly, the lower end extremity portion 100 of the actuator post 92 will be moved substantially vertically downwardly from the position shown at 100 to that shown at 100' whereby such lower end extremity portion 100 of the rocker actuator post 92 will now force the elevated central portion 104 of the snap-dome contact 88 to move downwardly into engagement with the upper end extremity portion of the electrical circuit contact pin 44.

Accordingly, the particular electrical circuit controlled by means of electrical circuit contact pin 44 is now disposed in its CLOSED state whereby, for example, an incremental servo or similar movement can be achieved. Obviously, simultaneously with the substantially vertically downward movement of the actuator post 92, the other actuator post 90 is moved correspondingly upwardly to the position 90' whereby the lower end extremity portion 98 of the actuator post 90 is now disposed entirely out of contact with, or disengaged from, the snap-dome contact 86. The electrical circuit therefore controlled by means of electrical circuit contact pin 42 remains in its CLOSED state. Upon release of the depression force from the fingertip surface portion 120 of the actuator 14, the snap-dome contact 88 will return to its non-depressed state and in turn cause the rocker actuator 14 to return to its normal state as shown at 14. The electrical circuit controlled by means of the electrical circuit contact pin 44 is now again OPEN, and it can be appreciated that CLOSED and OPEN states for such electrical circuit can be rapidly achieved depending upon the impression of a depression force, or the release of the same, upon or with respect to fingertip actuator portion 120. It is to be further appreciated that similar modes of operation are of course capable of being implemented with respect to actuator fingertip portion 118, actuator post 90, and snap-dome contact 86 in order to achieve alternative OPEN and CLOSED states of the electrical circuit operatively controlled by means of the electrical circuit contact pin 42. In this manner, opposite servo movements, that is, upward or downward, forward or backward, positive or negative, may be respectively controlled by means of the first and second electrical circuits which are in turn respectively controlled by means of the electrical circuit contact pins 42,44 and their respective electrical connections to the common or ground contact pin 76 through means of the ground plate 62 and the respective snap-dome contacts 86,88.

Thus, it may be seen that, in light of the foregoing, the new and improved rocker switch assembly 10, which is constructed in accordance with the principles and teachings of the present invention, is able to achieve rapid and accurate incremental servo movements due to the small throw or degree of movement achieved by means of the rocker assembly actuator 14 during a depression actuation or operation, as well as the tactile feedback provided to the operator so as to confirm in effect that a CLOSED state for a particular electrical circuit controlled by means of either one of the electrical circuit contact pins 42,44 has in fact been achieved. The small throw or degree of movement of the actuator 14, as well as the tactile feedback of the switch and circuit closure is, in turn, achieved as a result of several structural factors unique to the arrangement of the component parts of the rocker switch assembly 10 of the present invention.

More particularly, for example, the relatively small vertical throw or movement of the rocker actuator 14, and in particular, the throw or movement of the actuator posts 90,92, resides in the fact that the actuator posts 90, 92 are integral with the actuator plate portion 96, that the actuator posts 90,92 extend vertically downwardly from the actuator plate portion 96, and that the lower end extremity portions 98,100 are normally disposed in contact or engagement with the snap-dome contacts 86,88. No separate return spring elements or components are or need be interposed between the actuator posts 90,92 and the snap-dome contacts 86,88 or the electrical circuit contact pins 42,44. In addition, the substantial vertical alignment of the actuator posts 90,92, the elevated central portions 102,104 of the snap-dome contacts 86,88, and the electrical circuit contact pins 42,44, and the relative vertical movement of the actuator posts 90,92 and the elevated central portions 102,104 of the snap-dome contacts 86,88 with respect to the upper end extremity portions of the electrical circuit contact pins 42,44 serves to provide the operator with requisite degree of tactile feedback which is absolutely required in order to achieve the aforenoted rapid and accurate incremental servo movements.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A rocker switch assembly, comprising:

a rocker switch housing;

a ground contact and at least one electrical circuit contact pin fixedly mounted within said rocker switch housing, said ground contact and said at least one electrical circuit contact pin being normally electrically disengaged from each other;

at least one snap-dome contact mounted within said rocker switch housing such that a peripheral portion of said at least one snap-dome contact is normally disposed in electrical contact with said ground contact while a central elevated portion of said at least one snap-dome contact is normally electrically disengaged from said at least one electrical circuit contact pin;

a rocker actuator pivotally mounted upon said rocker switch housing and comprising a rocker plate portion; and at least one actuator post integral with said rocker plate portion of said rocker actuator and depending substantially vertically downwardly such that a lower end extremity portion of said at least one actuator post is normally disposed in contact with said central elevated portion of said at least one snap-dome contact whereby when said central elevated portion of said at least one snap-dome contact is disposed in a normal, non-depressed state, said central elevated portion of said at least one snap-dome contact biases said rocker actuator back to a normal, non-depressed position, whereas when a downward depression force is impressed upon said rocker actuator, said lower end extremity portion of said at least one actuator post causes said central elevated portion of said at least one snap-dome contact to be depressed into contact with said at least one electrical circuit contact pin through means of a short actuation stroke so as to electrically connect said ground contact to said at least one electrical circuit contact pin which is sensed by an operator by means of tactile feedback through said at least one dependent actuator post.

2. The rocker switch assembly as set forth in claim 1, wherein:

said ground contact comprises a ground contact pin and a ground plate.

3. A rocker switch assembly, comprising:

a rocker switch housing;

a ground contact comprising a ground contact pin and a ground plate, and at least one electrical circuit contact pin fixedly mounted within said rocker switch housing, said ground contact and said at least one electrical circuit contact pin being normally electrically disengaged from each other;

at least one snap-dome contact mounted within said rocker switch housing such that a peripheral portion of said at least one snap-dome contact is normally disposed in electrical contact with said ground contact while a central elevated portion of said at least one snap-dome contact is normally electrically disengaged from said at least one electrical circuit contact pin;

a rocker actuator pivotally mounted upon said rocker switch housing and comprising a rocker plate portion;

at least one actuator post integral with said rocker plate portion of said rocker actuator and depending substantially vertically downwardly such that a lower end extremity portion of said at least one actuator post is normally disposed in contact with said central elevated portion of said at least one snap-dome contact whereby when said central elevated portion of said at least one snap-dome contact is disposed in a normal, non-depressed state, said central elevated portion of said at least one snap-dome contact biases said rocker actuator back to a normal, non-depressed position, whereas when a downward depression force is impressed upon said rocker actuator, said lower end extremity portion of said at least one actuator post causes said central elevated portion of said at least one snap-dome contact to be depressed into contact with said at least one electrical circuit contact pin through means of a short actuation stroke so as to electrically connect said ground contact to said at least one electrical circuit contact pin which is sensed by an operator by means of tactile feedback through said at least one dependent actuator post;

a floor portion integrally formed within said rocker switch housing;

a pair of upstanding posts integrally formed upon said floor portion of said rocker switch housing; and a pair of first apertures defined within said ground plate for mating with said pair of upstanding posts formed upon said floor portion of said rocker switch housing so as to establish an interference fit therewith by means of which said ground plate is fixedly secured within said rocker switch housing.

4. The rocker switch assembly as set forth in claim 3, wherein:

each one of said pair of upstanding posts integrally formed upon said floor portion of said rocker switch housing comprises a plurality of crush ribs for interacting with said apertures of said ground plate in defining said interference fit between said ground plate and said pair of upstanding posts.

5. The rocker switch assembly as set forth in claim 3, wherein:

said floor portion comprises a pair of downwardly extending tubular posts for housing said ground contact pin and said at least one electrical circuit contact pin.

6. The rocker switch assembly as set forth in claim 3, wherein:

said ground plate is provided with at least one second aperture which annularly surrounds an upper end portion of said at least one electrical circuit contact pin and which has a diametrical extent which is greater than the diametrical extent of said upper end portion of said at least one electrical circuit contact pin such that said ground plate is normally electrically disconnected from said at least one electrical circuit contact pin.

7. The rocker switch assembly as set forth in claim 3, wherein:

said floor portion of said rocker switch housing comprises a plurality of scallop-shaped wall members; and said ground plate comprises a plurality of corresponding scallop-shaped cut-out regions for mating with said scallop-shaped wall members of said floor portion of said rocker switch housing whereby said ground plate is mounted upon said floor portion of said rocker switch housing in a positionally confined manner.

8. The rocker switch assembly as set forth in claim 7, wherein:

said at least one snap-dome contact has a substantially X-shaped configuration.

9. The rocker switch assembly as set forth in claim 8, wherein said at least one substantially X-shaped snap-dome contact comprises:

a plurality of scallop-shaped side portions for positionally cooperating with said scallop-shaped wall members of said floor portion of said rocker switch housing; and a plurality of leg members formed within corner regions of said at least one substantially X-shaped snap-dome contact for supporting said at least one substantially X-shaped snap-dome contact upon said ground plate.

10. A rocker switch assembly, comprising:

a rocker switch housing;

a ground contact having a downwardly extending ground contact pin and a ground plate in electrical contact with said ground contact pin;

first and second electrical circuit contact pins fixedly mounted within said rocker switch housing such that said first and second electrical circuit contact pins are normally electrically disengaged from said ground contact;

first and second snap-dome contacts mounted within said rocker switch housing such that a peripheral portion of each one of said first and second snap-dome contacts is normally disposed in electrical contact with said ground plate while a central elevated portion of each one of said first and second snap-dome contacts is normally electrically disengaged from a respective one of said first and second electrical circuit contact pins such that first and second electrical circuits controlled by said first and second electrical circuit contact pins are normally OPEN;

a rocker actuator pivotally mounted upon said rocker switch housing and comprising a rocker plate portion; and first and second actuator posts integral with said rocker plate portion of said rocker actuator and depending substantially vertically downwardly such that a lower end extremity portion of each one of said first and second actuator posts is normally disposed in contact with said central elevated portion of each one of said first and second snap-dome contacts whereby when said central elevated portions of both of said first and second snap-dome contacts are disposed in a normal, non-depressed state, said central elevated portions of both of said first and second snap-dome contacts bias said rocker actuator to a normal, non-depressed central position at which both of said first and second electrical circuits controlled by said first and second electrical contact pins are disposed in an OPEN state, whereas when a downward depression force is impressed upon one end of said rocker plate portion of said rocker actuator, said lower end extremity portion of one of said first and second actuator posts causes said central elevated portion of one of said first and second snap-dome contacts to be depressed into contact with one of said first and second electrical circuit contact pins through means of a short actuation stroke so as to electrically connect said ground contact to one of said first and second electrical circuit contact pins, which is sensed by an operator by means of tactile feedback through said one of said first and second dependent actuator posts, so as to dispose one of said first and second electrical circuits controlled by said first and second electrical circuit contact pins in a CLOSED state.

11. A rocker switch assembly, comprising:

a rocker switch housing;

a ground contact comprising a ground contact pin and a ground plate;

first and second electrical circuit contact pins fixedly mounted within said rocker switch housing such that said first and second electrical circuit contact pins are normally electrically disengaged from said ground contact;

first and second snap-dome contacts mounted within said rocker switch housing such that a peripheral portion of each one of said first and second snap-dome contacts is normally disposed in electrical contact with said ground contact while a central elevated portion of each one of said first and second snap-dome contacts is normally electrically disengaged from a respective one of said first and second electrical circuit contact pins such that first and second electrical circuits controlled by said first and second electrical circuit contact pins are normally OPEN;

a rocker actuator pivotally mounted upon said rocker switch housing and comprising a rocker plate portion;

first and second actuator posts integral with said rocker plate portion of said rocker actuator and depending substantially vertically downwardly such that a lower end extremity portion of each one of said first and second actuator posts is normally disposed in contact with said central elevated portion of each one of said first and second snap-dome contacts whereby when said central elevated portions of both of said first and second snap-dome contacts are disposed in a normal, non-depressed state, said central elevated portions of both of said first and second snap-dome contacts bias said rocker actuator to a normal, non-depressed central position at which both of said first and second electrical circuits controlled by said first and second electrical contact pins are disposed in an OPEN state, whereas when a downward depression force is impressed upon one end of said rocker plate portion of said rocker actuator, said lower end extremity portion of one of said first and second actuator posts causes said central elevated portion of one of said first and second snap-dome contacts to be depressed into contact with one of said first and second electrical circuit contact pins through means of a short actuation stroke so as to electrically connect said ground contact to one of said first and second electrical circuit contact pins, which is sensed by an operator by means of tactile feedback through said one of said first and second dependent actuator posts, so as to dispose one of said first and second electrical circuits controlled by said first and second electrical circuit contact pins in a CLOSED state;

a floor portion integrally formed within said rocker switch housing;

a pair of upstanding posts integrally formed upon said floor portion of said rocker switch housing; and a pair of first apertures defined within said ground plate for mating with said pair of upstanding posts formed upon said floor portion of said rocker switch housing so as to establish an interference fit therewith by means of which said ground plate is fixedly secured within said rocker switch housing.

12. The rocker switch assembly as set forth in claim 11, wherein:

each one of said pair of upstanding posts integrally formed upon said floor portion of said rocker switch housing comprises a plurality of crush ribs for interacting with said apertures of said ground plate in defining said interference fit between said ground plate and said pair of upstanding posts.

13. The rocker switch assembly as set forth in claim 11, wherein:

said floor portion comprises three downwardly extending tubular posts for housing said ground contact pin and said first and second electrical circuit contact pins.

14. The rocker switch assembly as set forth in claim 11, wherein:

said ground plate is provided with a pair of second apertures which annularly surround an upper end portion of each one of said first and second electrical circuit contact pins and which have diametrical extents which are greater than the diametrical extents of said upper end portions of said first and second electrical circuit contact pins such that said ground plate is normally electrically disconnected from said first and second electrical circuit contact pins.

15. The rocker switch assembly as set forth in claim 11, wherein:

said floor portion of said rocker switch housing comprises a plurality of scallop-shaped wall members; and said ground plate comprises a plurality of corresponding scallop-shaped cut-out regions for mating with said scallop-shaped wall members of said floor portion of said rocker switch housing whereby said ground plate is mounted upon said floor portion of said rocker switch housing in a positionally confined manner.

16. The rocker switch assembly as set forth in claim 15, wherein:

each one of said first and second snap-dome contact has a substantially X-shaped configuration.

17. The rocker switch assembly as set forth in claim 16, wherein each one of said first and second substantially X-shaped snap-dome contacts comprises:

a plurality of scallop-shaped side portions for positionally cooperating with said scallop-shaped wall members of said floor portion of said rocker switch housing so as to positionally locate said first and second snap-dome contacts within said rocker switch housing; and a plurality of leg members formed within corner regions of said first and second substantially X-shaped snap-dome contacts for supporting said first and second substantially X-shaped snap-dome contacts upon said ground plate.

* * * * *